US008696485B2

(12) United States Patent
Pies et al.

(10) Patent No.: US 8,696,485 B2
(45) Date of Patent: Apr. 15, 2014

(54) GOLF PLANE TRAINING DEVICES

(76) Inventors: Russell Louis Pies, Potomac, MD (US); Patrick J. Bedingfield, Olney, MD (US)

( * ) Notice: Subject to any disclaimer, the term of this patent is extended or adjusted under 35 U.S.C. 154(b) by 432 days.

(21) Appl. No.: 13/147,708

(22) PCT Filed: Jan. 29, 2010

(86) PCT No.: PCT/US2010/022462
§ 371 (c)(1),
(2), (4) Date: Aug. 3, 2011

(87) PCT Pub. No.: WO2010/090947
PCT Pub. Date: Aug. 12, 2010

(65) Prior Publication Data

US 2011/0294588 A1 Dec. 1, 2011

Related U.S. Application Data

(60) Provisional application No. 61/299,017, filed on Jan. 28, 2010, provisional application No. 61/149,730, filed on Feb. 4, 2009.

(51) Int. Cl.
*A63B 69/36* (2006.01)

(52) U.S. Cl.
USPC ..... 473/265; 473/257; 473/264

(58) Field of Classification Search
USPC ..... 473/257, 264, 265
See application file for complete search history.

(56) References Cited

U.S. PATENT DOCUMENTS

| | | | | | |
|---|---|---|---|---|---|
| 482,836 | A | | 9/1892 | Wyant | |
| 1,637,339 | A | * | 8/1927 | Glennon et al. | 473/265 |
| 3,482,838 | A | * | 12/1969 | Gibson et al. | 473/264 |
| 3,741,550 | A | * | 6/1973 | Landures | 473/265 |
| 4,526,373 | A | | 7/1985 | Medlock | |
| 4,732,390 | A | * | 3/1988 | McCollum | 473/264 |
| 4,913,440 | A | * | 4/1990 | Ellington | 473/265 |
| 4,930,786 | A | * | 6/1990 | Bencriscutto | 473/265 |
| 5,026,065 | A | | 6/1991 | Bellagamba | |
| 5,255,921 | A | | 10/1993 | Spence | |
| 5,423,548 | A | | 6/1995 | Bricker | |
| 5,513,842 | A | | 5/1996 | Fuss | |
| D407,773 | S | * | 4/1999 | Greig | D21/791 |
| 7,001,285 | B1 | * | 2/2006 | Ahrend | 473/265 |
| 7,214,140 | B2 | * | 5/2007 | Coombs | 473/278 |
| 7,431,661 | B1 | * | 10/2008 | Cailey | 473/257 |
| 7,566,277 | B2 | * | 7/2009 | Dahl | 473/265 |
| D641,448 | S | * | 7/2011 | Sessions | D21/791 |
| 8,529,366 | B2 | * | 9/2013 | Butler et al. | 473/265 |
| 2003/0199330 | A1 | | 10/2003 | Magallanes | |
| 2004/0048680 | A1 | * | 3/2004 | O'Connor et al. | 473/265 |
| 2004/0142757 | A1 | * | 7/2004 | Ahrend | 473/265 |
| 2006/0019764 | A1 | * | 1/2006 | Gegelys | 473/265 |

(Continued)

OTHER PUBLICATIONS

International Search Report and Written Opinion (mailed Mar. 31, 2010).

*Primary Examiner* — Raleigh W Chiu
(74) *Attorney, Agent, or Firm* — Jeffrey S. Melscher; Manelli Selter PLLC

(57) ABSTRACT

A golf plane device for use at full golf swing speed and to strike golf balls that trains the golfer to swing the club on the proper golf shaft plane. The device includes a set of bottom 10 and top 8 flexible guides through which the golf shaft 20 travels from thigh high on the downswing to thigh high on the follow through.

33 Claims, 12 Drawing Sheets

(56) References Cited

U.S. PATENT DOCUMENTS

| | | | | |
|---|---|---|---|---|
| 2006/0040760 | A1* | 2/2006 | Du Preez | 473/265 |
| 2007/0032307 | A1* | 2/2007 | Coombs | 473/262 |
| 2007/0087856 | A1 | 4/2007 | Rodriguez | |
| 2007/0238542 | A1* | 10/2007 | Pecue | 473/257 |
| 2008/0227561 | A1* | 9/2008 | Dahl | 473/251 |
| 2009/0062028 | A1* | 3/2009 | Wu et al. | 473/265 |
| 2009/0111598 | A1* | 4/2009 | O'Brien et al. | 473/224 |
| 2011/0111876 | A1* | 5/2011 | Hart | 473/257 |
| 2011/0294588 | A1* | 12/2011 | Pies et al. | 473/257 |

* cited by examiner

GOLF PLANE TRAINING DEVICES

This application claims priority to U.S. Provisional Patent App'n Ser. Nos. 61/149,730, filed 4 Feb. 2009, and 61/299,017, filed 28 Jan. 2010, the complete disclosures of which are incorporated herein by reference.

FIELD OF INVENTIONS

The inventions relate to devices that can be used during a full golf swing and golf ball strike to train the golfer to swing the club on the proper golf shaft plane.

BACKGROUND OF THE INVENTIONS

Golf clubs generally have three parts, the grip, the head, and the shaft that connects the grip to the head. The head, has a face designed to contact a golf ball. Each face has a sweet spot which is the most efficient portion of the face at transferring the force from the moving golf club to the ball.

Golf swings can be broken down into the following three parts. The address is when the golfer places the golf club behind the resting ball in a ready position to hit the ball. The backswing is when the golfer moves the club backward away from the ball, which mostly involves rotating the club around the golfer's body. The downswing is the movement of the club back to the ball, which mostly involves rotating the club in the opposite direction to the backswing.

The word "plane" was made popular by Ben Hogan many years ago. When viewed from the side of the golfer during the downswing, the plane is an invisible line on which the shaft of the club should travel toward the ball. For a baseball swing, that plane is basically parallel the ground. However, since the golf ball is resting on the ground, the club moves back into the ball at an angle to the ground and, thus, the swing plane is at an angle to the ground. The swing plane is optimally the same angle as the angle of the shaft during address. If the club is properly fitted to the golfer, the angle of the shaft during address will be the same as the lie angle of the club.

In most golf shots, the desired club shaft approach to the ball during the downswing is from the inside and then after contact the shaft moves again back inside, like a big gentle curve. While this movement sounds simple, the proper movement is not only very difficult to attain but also to retain.

U.S. Pat. No. 482,836 discloses a golf swing training device. This device uses rigid rails to align the head of a golf club during the swing. The use of such rigid rails provides a danger of causing damage to the golf club and/or golfer during a full golf swing. Furthermore, the rails do not provide a clear visual representation of the downswing golf shaft plane in either the vertical direction or the horizontal direction. The rails cannot be made narrower than the width of the club head, and in fact, must be far further apart than the width of the club head to allow the club head to move freely there between. Thus, this device cannot show the shaft plane, which is narrower than the width of the club head. Moreover, this device is large and cumbersome.

U.S. Pat. No. D407,773 discloses a golf club swing path and face angle measuring device. FIG. 2 shows a curved path the club head takes. The bristles extending from the base in a horizontal direction are sized and placed to direct the club head. Since the club head can rotate during the swing, directing the club head will not ensure that the club shaft is on the correct plane. Furthermore, the curved path of the bristles does not provide a clear visual representation of the downswing golf shaft plane in either the vertical direction or the horizontal direction.

U.S. Pat. No. 7,431,661 discloses a golf swing and putting trainer. The trainer includes rigid guides 31 and 32. While the rigid guides 31 and 32 can optionally be padded with foam, the use of such padded rigid rails provides a danger of causing damage to the golf club and/or golfer during a full golf swing. Furthermore, the use of rigid foam padded guides does not provide a clear visual representation of the downswing golf shaft plane in either the vertical direction or the horizontal direction. Moreover, since the guides are rigid, they must be placed far apart to ensure that the club does not contact them during use and the minimum distance between the guides is far larger than the length of a golf club head.

There are no known devices that can be used during a full swing to contact a ball so that the proper shaft plane can be quickly learned and grooved in. Furthermore, there are no known devices that are easily portable for use at any desired location, such as a golf range.

SUMMARY OF THE INVENTIONS

The Plane Finder is a training device that will quickly improve golfers' swing and ball contact. All great golf shots have a few things in common. The ball must contact the sweet spot on the club face. The club must approach the ball in a certain manner, such as not too steep or too shallow, and not too much from the inside or the outside. The Plane Finder provides a visual representation of the direction the club shaft travels during the down swing so that the club approaches the ball on the proper plane, and also from the desired direction. Proper contact between the ball and the sweet spot on the club face is also improved by having the club shaft on the proper plane.

The Plane Finder is the first training aid designed for golf that will allow a swing at full speed and provide feedback on the proper shaft plane. The Plane Finder provides a track in which the club shaft must basically fit from set up to thigh high in the back swing, then upon reaching thigh high on the downswing to impact and to thigh high in the follow through. Thus, from thigh high in both directions, the club shaft will be running through the Plane Finder. Thigh high is almost always identical among tour professionals.

Unlike other commercial training aids such as the Inside Approach, EZ Plane Trainer, Dual Track Trainer and others, the Plane Finder has top and bottom side guides, can be used while hitting balls at full speed, can be adjusted for poor golfers and top professionals, gently lets the golfer know when they are off shaft plane, and will not damage the club. The guides can be closer than the length of the club head to accurately show the shaft plane. For example, for an advanced golfer the guides can set slight farther apart than the golf shaft, which is far narrower than the length of a golf club.

The Plane Finder provides instant feedback when the shaft is off plane. When the shaft is off plane, one or more guides will deflect or fold back. The deflected or folded guide(s) provide feedback as to where in the swing the shaft was taken off plane so that the golfer can adjust the swing to keep the shaft on the proper plane.

The Plane Finder will also improve the golfer's set up by preventing poor slouching posture and improper set up, such as being close to the ball or too tall that the swing is too straight up and down. The top and bottom guides can be adjusted for all body types and club lengths. Having a good set-up is often over looked in training aids and when addressed it is not combined with being able to hit ball at full speed.

The Plane Finder has a bottom guide that will guide the player into impact without having the grip of the club approach the ball too low, which often occurs in better players, and a top guide that will be used by poor golfers to prevent the dreaded over the top swing, which most golfers end up hitting the slice with. Thus, the Plane Finder is beneficial for all playing abilities.

After impact, the swing is not over. The club shaft should desirably continue on plane and be a replica of the approaching downswing into impact. The Plane Finder's guides deal with post impact and insures the swing is on shaft plane until thigh high is passed.

The Plane Finder addresses the most commonly mentioned and yet misunderstood word in golf, shaft plane. The Plane Finder will assist a golfer in producing a repeatable approach to the golf ball at a proper angle.

The Plane Finder comprises a base constructed and arranged to provide a first ground support which during use is on a first side of a resting golf ball facing a golfer addressing the golf ball, a second ground support which during use is on a second side of the resting golf ball facing away from the golfer addressing the golf ball, and a connector connecting the first and second ground supports, at least two bottom supports connected to the first ground support, at least two top supports connected to the second ground support, at least one bottom guide protruding from each bottom support and at least one top guide protruding from each top support. The top and bottom guides are deflectable so that when a golf shaft contacts the guides during a golf swing the guides deflect without causing damage to the golf shaft. The bottom and top guides define a space there between through which the golf shaft travels during a downswing and follow through of a golf swing. The space provides a visual representation of a plane the club shaft travels on the downswing and follow through of a golf swing. At least one of the guides or supports is movable to provide different plane angles. The distance between the bottom and top guides is adjustable to change a width of the space there between. The guides protruding from the supports are constructed and arranged to provide clearance for a club head under the guides and to provide a minimum space width narrower than a width of the club head.

Also provided is a method of obtaining feedback on a golf plane comprising setting up the Plane Finder, setting a desired plane angle defined by the space between the guides, setting a width of the space between the guides that is wider than a golf club shaft, placing a golf ball in the Plane Finder, and swinging a golf club so that a face of the golf club head strikes the golf ball. The shaft travels in the space between the guides, and the head travels below the guides. Feedback is provided by the space between the guides and when the shaft strikes a deflectable guide.

DETAILED DESCRIPTION OF THE INVENTIONS

The inventions will now be described in reference to the attached non-limiting drawings.

Figure 1:
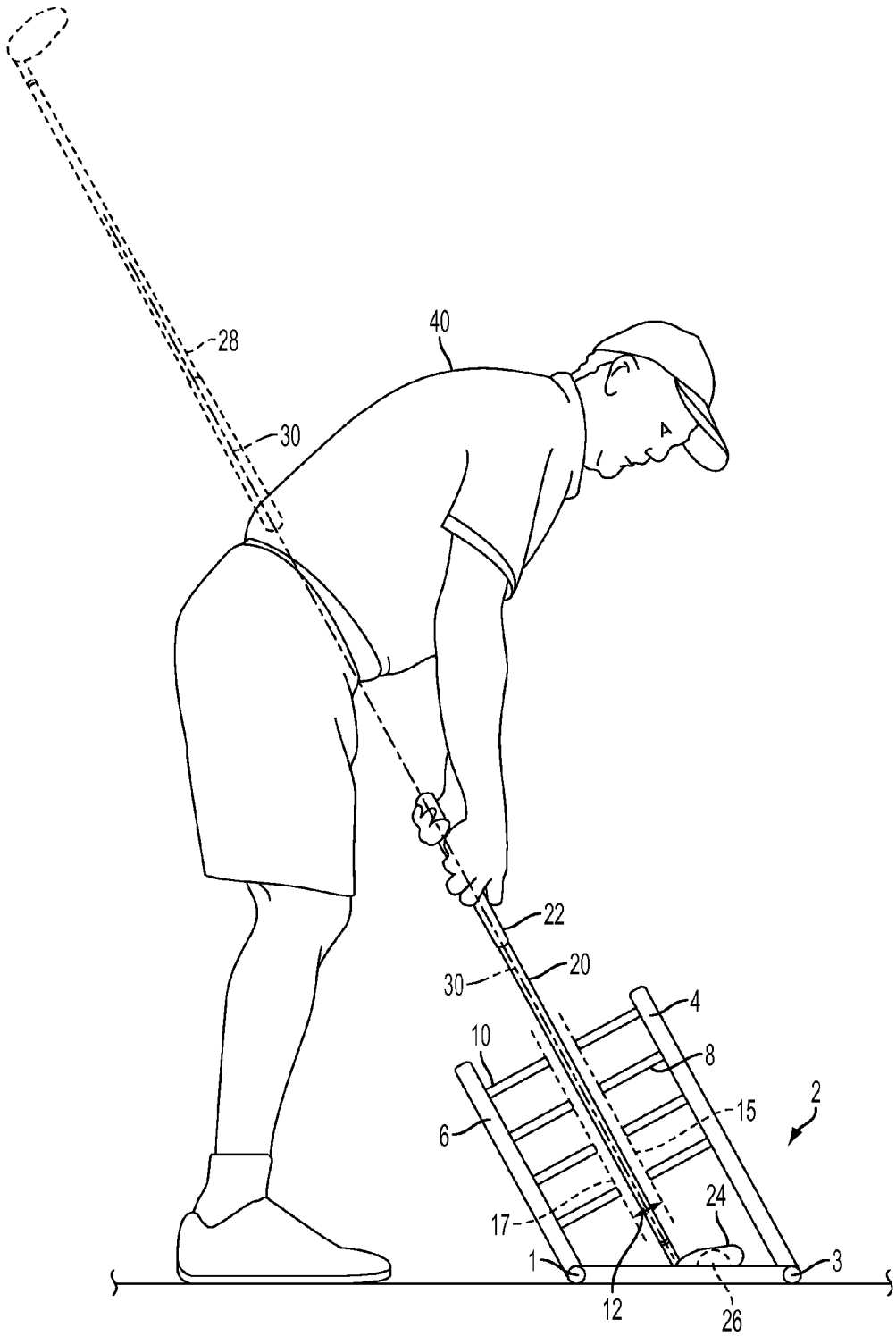
FIG. 1 illustrates a cut away view of the Plane Finder through the resting golf ball and golfer.

FIG. 1 shows a cut away view of the Plane Finder 2 though a resting golf ball 26 and a golfer 40. The golf club at impact with the golf ball 26 is shown by the shaft 20, the grip 22 and head 24. The shaft 28 shows the golf club at approximately half way through the downswing. The plane 30 is the plane on which the golf shaft swings through the downswing and follow through.

Though impact, the shaft 20 travels though the Plane Finder 2. The Plane Finder 2 has at least two top guides 8 spaced apart in a horizontal direction of the plane 30 and at least two bottom guides 10 spaced apart in a horizontal direction of the plane 30. Preferably, the Plane Finder 2 has at least two top guides 8 spaced apart in a horizontal direction of the plane 30 and at least three bottom guides 10 spaced apart in a horizontal direction of the plane 30 as shown by the highest guide 8 on each of the two top supports 4 and by the highest guide 10 on each of the three bottom supports 6 in FIG. 2.

Figure 3:
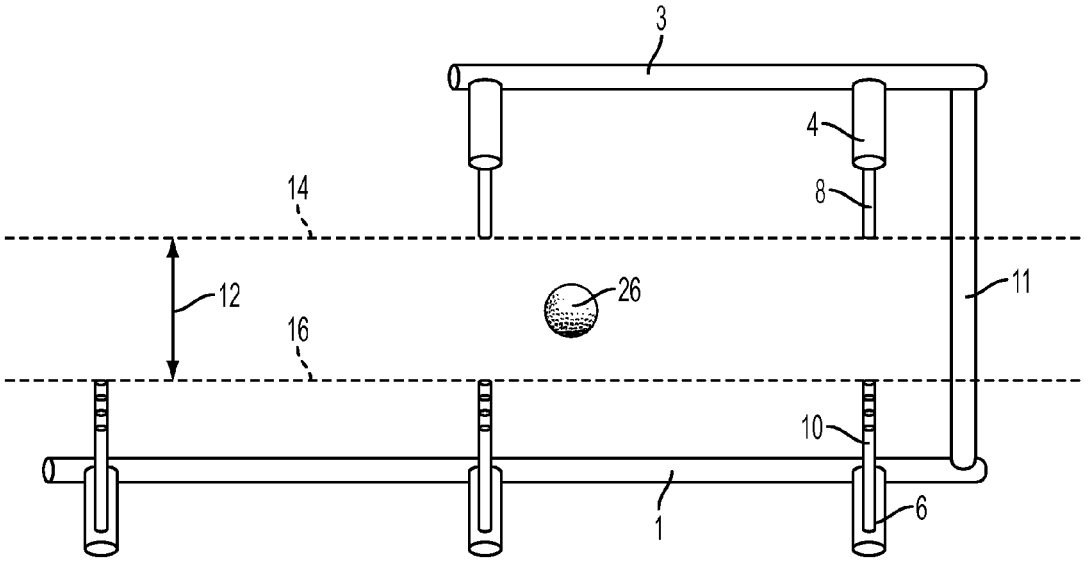
FIG. 3 illustrates a view of the Plane Finder from the perspective of a golfer addressing the ball.

As shown in FIGS. 1 and 3, the top guides 8 and bottom guides 10 define a space having a width 12 that is sufficient to allow the shaft 20 to swing therethrough. Preferably, the width 12 is adjustable by the user so that less experienced golfers can have a wider width 12 and better golfers can have a narrower width 12 as desired. Examples of suitable widths 12 are 6 or less inches (15 or less cm), preferably from slightly greater than a golf shaft thickness to 6 inches (15 cm), more preferably from 1 to 4 inches (2 to 10 cm).

The guides 8 and 10 should be of a sufficient length to ensure that the shaft 20 and head 24 will not contact the top supports 4 or the bottom supports 6 during a swing at full speed. Examples of suitable lengths for the guides 8 and 10 are from 6 to 24 inches (15 to 61 cm), preferably from 10 to 20 inches (25 to 50 cm), and most preferably from 12 to 15 inches (30 to 38 cm).

Figure 2:
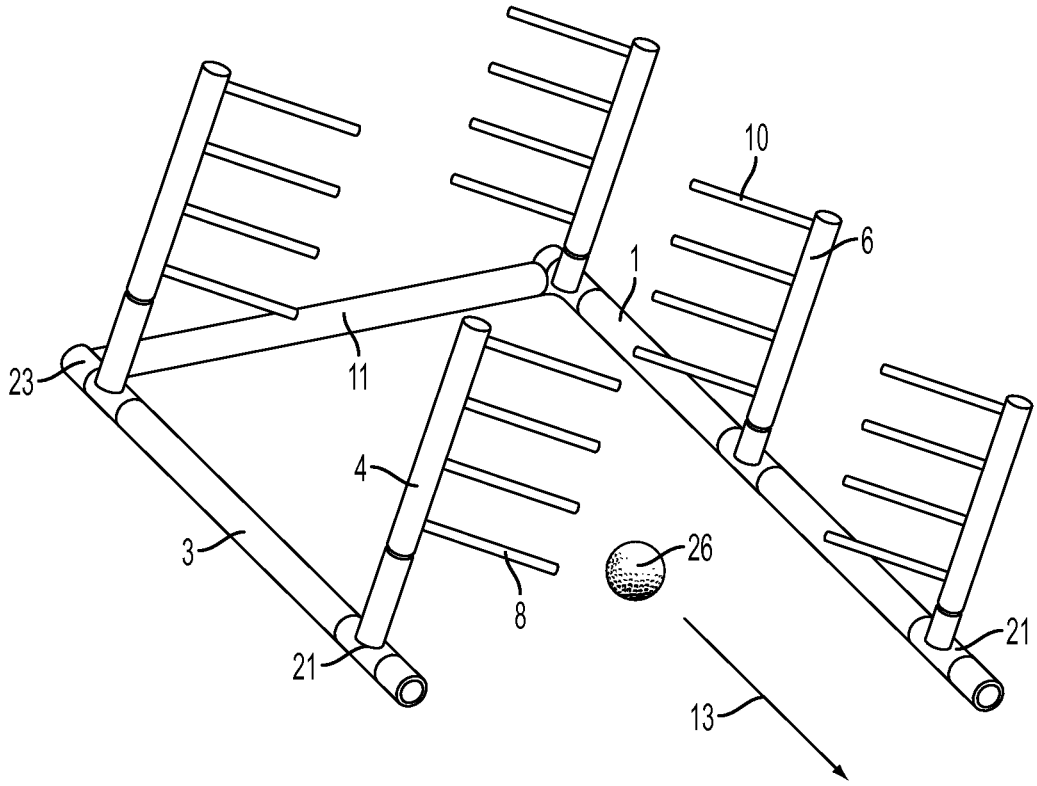
FIG. 2 illustrates an angled view of the Plane finder.
Figure 4:
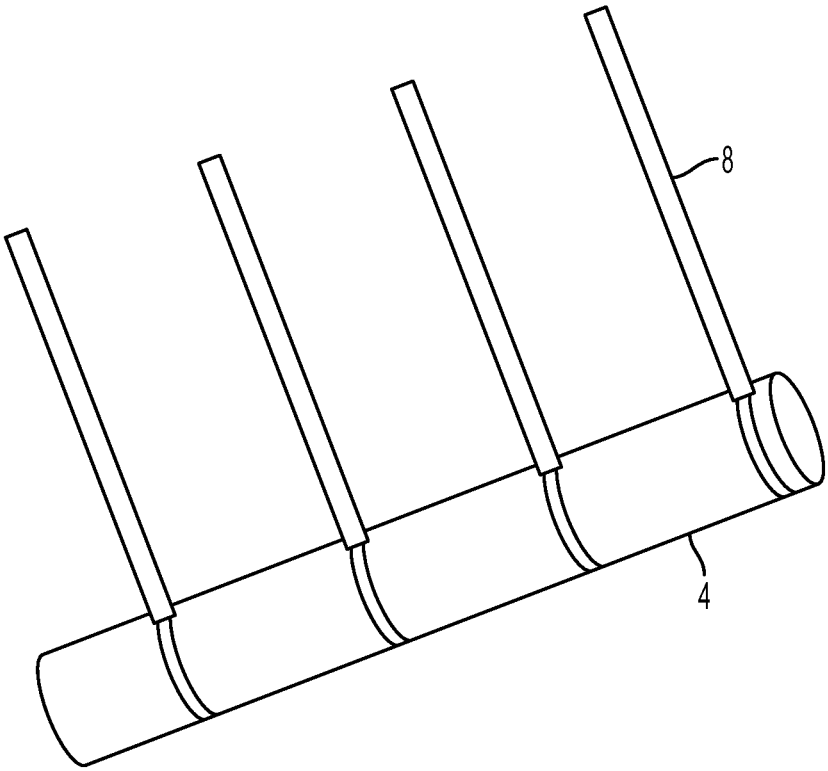
FIG. 4 illustrates an example of the guides.

As shown in FIGS. 1, 2 and 4, the guides 8 and 10 should be arranged on a sufficient length of the respective supports 4 and 6 to provide a clear visual representation of the plane 30 in the vertical direction as shown by the substantially parallel dotted lines at 15 and 17. Examples of suitable distances are from 5 to 24 inches (12 to 61 cm), preferably from 6 to 15 inches (15 to 38 cm) and most preferably from 8 to 12 inches (20 to 30 cm). If zip ties are utilized, the zip ties can be placed at any desired distance, for example from 1 to 6 inches (2 to 15 cm) apart, preferably 1 to 2 inches (2 to 5 cm) apart on the length of the supports 4 and 6.

The guides 8 and 10 must be higher than the typical height of a golf club head 24 measured from the ground. For example, the bottom guides 10 are usually at least 6 inches (15 cm), preferably 8 to 18 inches (20 to 45 cm), from the ground to provide sufficient clearance for the head 24 to pass thereunder. For example, the top guides 8 are usually at least 12 inches (30 cm), preferably 18 to 30 inches (45 to 61 cm), from the ground to provide sufficient clearance for the head 24 to pass thereunder. The top guides 8 will generally require more clearance than the bottom guides 10 because the top guides 8 are angled towards the ground and the free end of the guides 8 will be closer to the ground than the mounted end on the supports 4. In this manner, while the supports 4 and 6 are far apart to provide sufficient distance for the club head 24 to pass through and avoid contact with the supports 4 and 6, the distance between the guides 8 and 10 (represented by width 12) can be far smaller than the length of the golf club head, such as slightly greater than the thickness of a golf shaft 20, to provide a clear visual image of the plane 30.

The guides 8 and 10 can be formed from any flexible material and shaped as desired so that the guides 8 and 10 are easily deflectable when struck by a shaft 20 and return to the static position after being struck by a shaft 20. Examples of preferred materials are composites and plastics. Examples of suitable guides 8 and 10 are well known zip ties, as shown in FIG. 4. Zip ties are easily replaced, inexpensive, easily obtained, can be easily sized for length by cutting, and are easily mounted to the supports 4 and 6 by their known fastening means.

In another embodiment, the flexible guides 8 and 10 can be replaced or include one or more guides that when deflected by the shaft 20 remain in the deflected position to provide feedback on which guides 8 and 10 were deflected and by how much. The golfer can bend the deflected guide back to a starting position for reuse. An example of such a guide is a hinged guide.

The Plane Finder 2 can also be used to help setup, address and the start of the backswing on the desired plane 30.

While the guides 8 and 10 and supports 4 and 6 can be positioned as desired in the horizontal direction, preferably, at least one set of supports 4 and 6 are positioned so that the associated guides 8 and 10 are aligned substantially opposite one another as shown in FIG. 3.

Thus, the location, size and number of guides 8 and 10 provides a clear visual representation of the plane 30 in a horizontal direction as shown by the substantially parallel dotted lines at 14 and 16 and the vertical direction as shown by the substantially parallel dotted lines at 15 and 17. This visual representation is also made clear because the space between the guides 8 and 10 shown at width 12 can be made quite small because of the flexible nature of the guides 8 and 10. In general, the smaller the width 12 the more defined the plane 30 will be to the golfer. Since the guides 8 and 10 can be set slightly greater than the thickness of the golf shaft 20 and the guides 8 and 10 are above ground level to provide clearance for the golf head 24, the plane 30 can be precisely defined and suspended in air. Furthermore, the guides 8 and 10 do not materially reroute an errant golf swing, in the way rigid guides would. Instead, the flexing of the guides 8 and 10 provides feedback so that the golfer can adjust the plane of the shaft 20 in response thereto.

The Plane Finder 2 includes a ground support on both sides of the ball 26. The first ground support 1 is on the side of the ball 26 facing the golfer 40. The second ground support 3 is on the side of the ball 26 facing away from the golfer 40. The first support 1 and second ground support 3 can be connected by a connector 11. The ground support should be free of any encumbrance in front of the ball 26 so that the when the ball 26 is struck at full speed with the face of the head 24 the ball 26 is not deflected by the ground support, shown by 13 in FIG. 2.

The width 12 can, for example, be adjusted by at least one of adjusting the length of the guides 8 and/or 10, and/or by adjusting the distance between the first and second ground supports 1 and 3. A length adjustable connector 11 can be used or at least one of the mounts between the connector 11 and the first ground support 1 or second ground support 3 can be adjustable to adjust the distance between the first and second ground supports 1 and 3. Another example of how the width 12 can be adjusted is by adjusting the length of the guides 8 and 10.

The guides 10 are connected to the first ground support 1 by one or more bottom supports 6. The guides 8 are connected to the second ground support 3 by one or more top supports 4. While FIGS. 1-3 shows the preferred three bottom supports 6 and two top supports 4, any desired number of supports 4 and 6 can be used. However, if the supports 4 and 6 are poles are shown in FIGS. 1-3, there must be at least two bottom supports 6 and at least two top supports 4 and at least two guides 8 so the guides 8 can be spaced from one another in a horizontal direction and at least two guides 10 so that the guides 10 can be spaced from one another in a horizontal direction to provide a visual representation of the plane 30 in a horizontal direction, as shown by the substantially parallel lines 14 and 16 in FIG. 3.

The supports 4 and 6 and ground supports 1 and 3 can be formed from any rigid material. An example is well known PVC piping and joints to provide lightweight, easily erected, weather-resistant device. Another example is aluminum or other metal. Preferably, the Plane Finder 2 is constructed and arranged to be foldable for easy storage and transportation.

Figure 5:
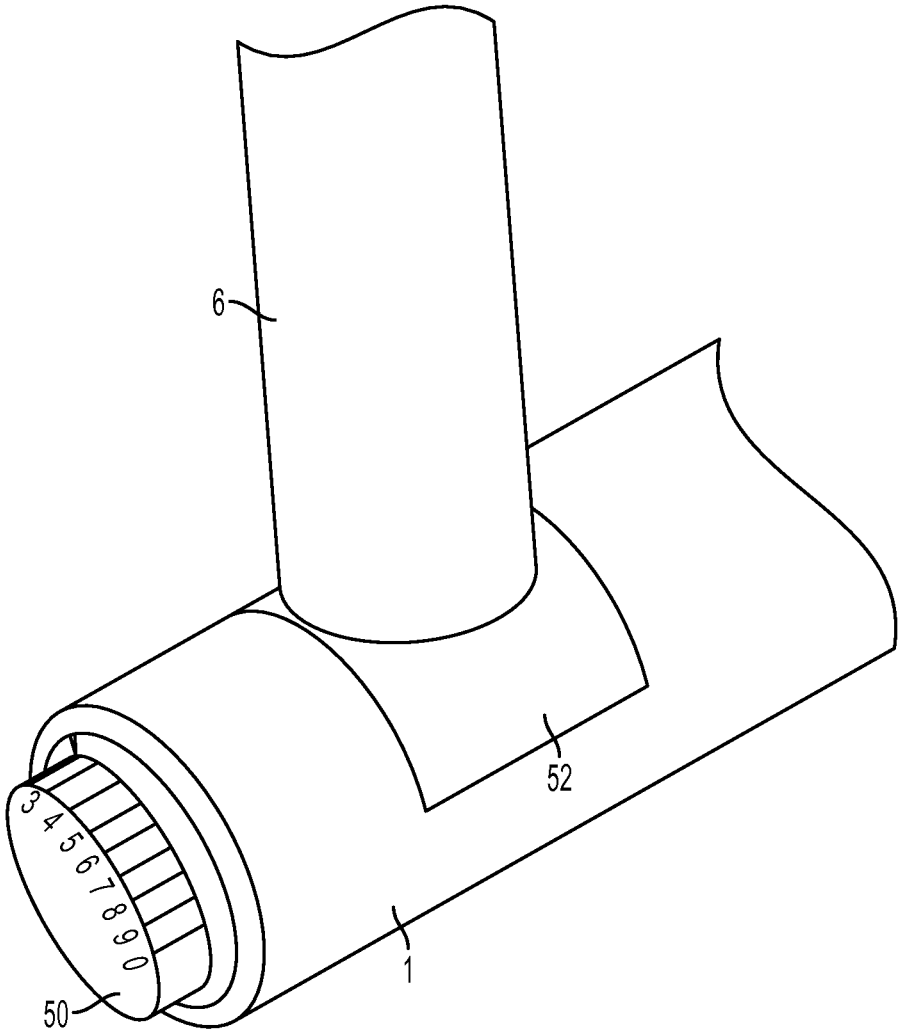
FIG. 5 illustrates an indicator.

The supports 4 and 6 can be movably mounted to the ground support so that the angle of the plane 30 can be adjusted. Examples of suitable movable mounts for mounting the supports 8 and 10 to the ground support are shown in U.S. Pat. No. 7,431,661 (at connectors 27 and 31), the complete disclosure of which is incorporated herein by reference. Another example of a movable support is shown at 52 in FIG. 5.

The supports 4 are preferably non-movable in relation to one another so that they move as a unit to ensure that they remain in a substantially straight line as the angle of the plane 30 is adjusted. The supports 6 are preferably non-movable in relation to one another so that they move as a unit to ensure that they remain in a substantially straight line as the angle of the plane 30 is adjusted. If PVC or other piping is utilized, when the mounts should be non-movable the T-connectors can be glued or otherwise fastened, and when movement is desired the connectors can be only friction fit without glue. The FIGS. 2-4 show PVC pipe structures connected using well-known T-connectors and corner connectors. The T-connectors 21 mounting the supports 4 to the lower support 3 are glued so that the supports 4 turn as a unit, and the T-connectors 21 mounting the supports 6 to the supports 1 can be glued so that the supports 6 turn as a unit. The corner connectors 23 to the supports 1 and 3 are friction fit so that the supports 1 and 3 can rotate. In this manner the plane 30 can easily be adjusted by turning the supports 1 and 3.

If desired, the Plane Finder can include an indicator 50 for setting the angle of the supports 4 and 6, such as a number or degree indicator.

The height and location of the supports 4 and 6 and guides 8 and 10 should be sufficient to provide feedback from thigh height of the golfer during the downswing into contact of the ball 26 and the follow through to thigh height of the golfer. Thigh height will be understood to be an average thigh height, such as from 2 to 3 feet. The height of the bottom support 6 should low enough such that a golfer does not contact the bottom support 6 with the hands during the swing. Preferably, the height of the top support 4 is longer than the height of the bottom support 6, as shown in FIG. 1-3, but they can any desired height relative to one another. Examples of suitable heights for the bottom support 6 are from 6 to 24 inches (15 to 61 cm), preferably 10 to 18 inches (25 to 45 cm). Examples of suitable heights for the top supports 4 are from 10 to 30 inches (25 to 76 cm), preferably 12 to 24 inches (30 to 61 cm). If desired, the supports 4 and 6 can be height adjustable.

Preferably, the bottom guides 10 extend further in the horizontal direction as shown in FIGS. 1-3 to provide feedback during the follow through after contact with the ball 26. Any desired length of the Plane Finder 2 can be used. To provide feedback in both the downswing and follow through at thigh height, the distance between the farthest apart bottom guides 10 in the horizontal direction is preferably from 4 feet to 8 feet, and the distance between the farthest two top guides 8 in the horizontal direction is preferably 4 feet to 6 feet.

Another embodiment of the Plane Finder 2 is illustrated in FIGS. 6 through 13F. Like numbers for this embodiment are as described in the previous embodiments. The Plane Finder 2 in this embodiment has the same basic setup, dimensions, and use as described in the previous embodiments set forth above, but uses alternative parts for ease of disassembly and assembly as set forth below.

Figure 6:
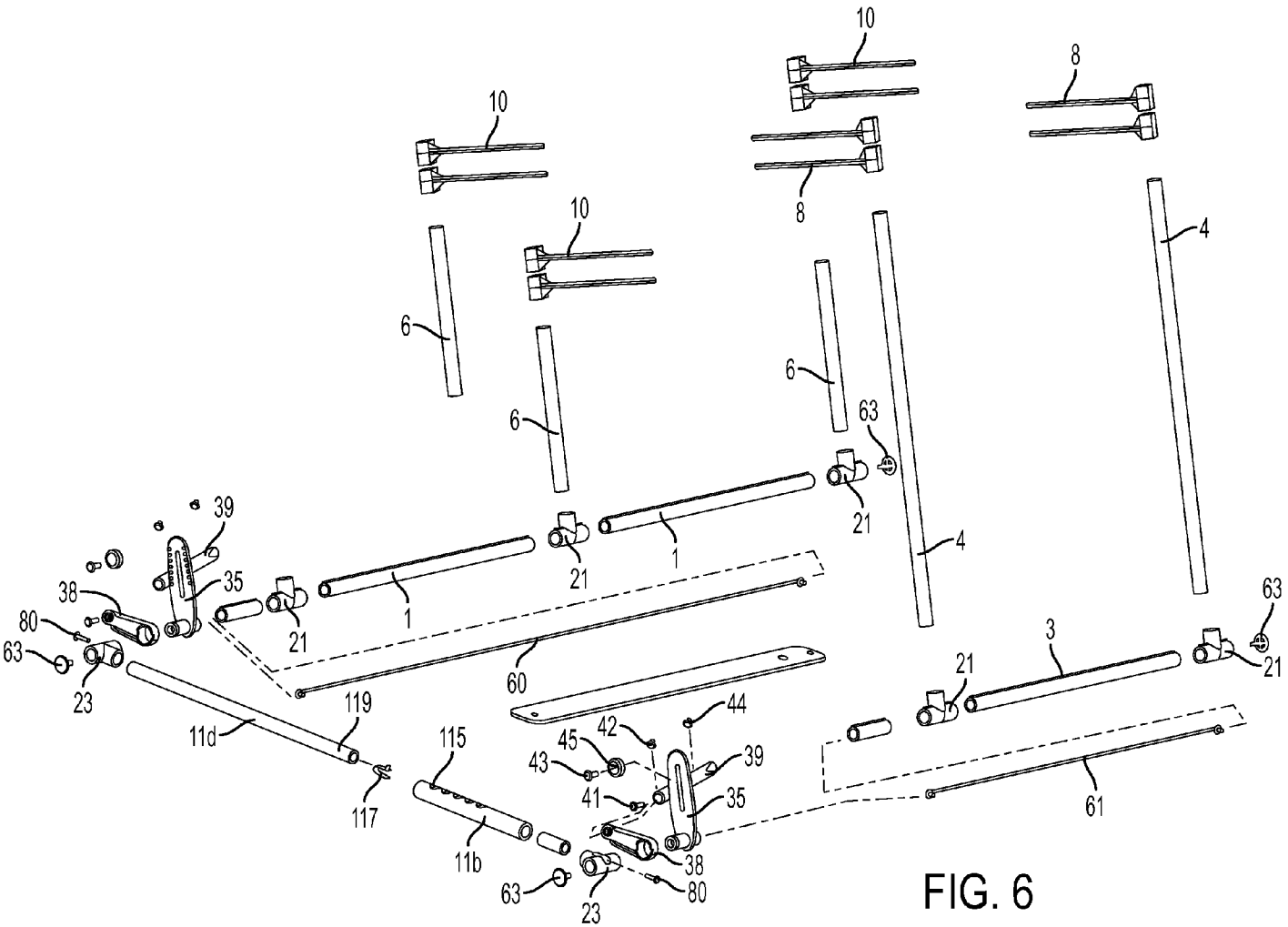
FIG. 6 illustrates a view of the parts of an embodiment of the Plane Finder.

FIG. 6 illustrates an exploded view of the Plane Finder 2. The Plane Finder 2 has at least two top supports 4, at least two bottom supports 6, first and second ground supports 1 and 3, and a connector represented by connector sections 11*a* and 11*b* formed from polyvinylchloride (PVC). PVC T-connectors 21 are used to connect the top supports 4 to the second ground supports 3 and the bottom supports 6 to the ground supports 1. Preferably, the top supports 4 are not permanently glued to associated T-connectors 21 and the bottom supports 6 are not permanently glued to associated T-connectors 21 so that they can be removed and assembled for use as desired. Preferably, the ground supports 1 and 3 are not permanently glued to the T-connectors 21 so that they can be removed and assembled for use as desired.

Figure 7:
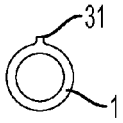
FIG. 7 illustrates a side view of a ground support.
Figure 8A:
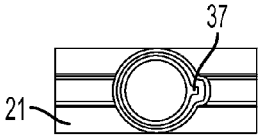
FIGS. 8A-8C illustrate views of a T-connector.
Figure 8B:
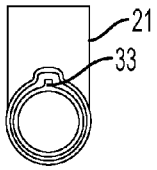
Figure 8C:
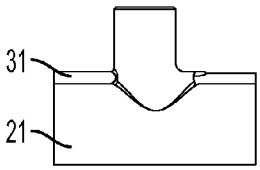
Figure 9A:
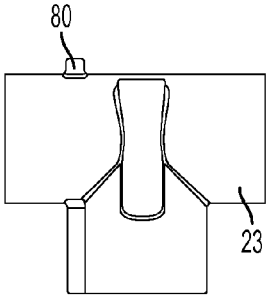
FIGS. 9A-9E illustrate views of a corner connector.
Figure 9B:
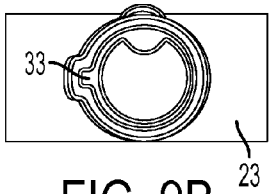
Figure 9C:
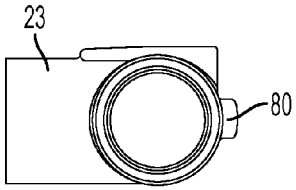
Figure 9D:
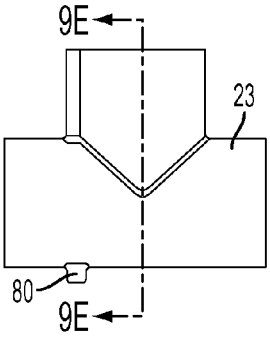
Figure 9E:
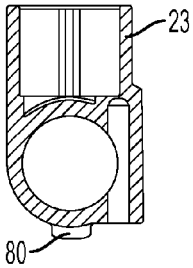
Figure 10A:
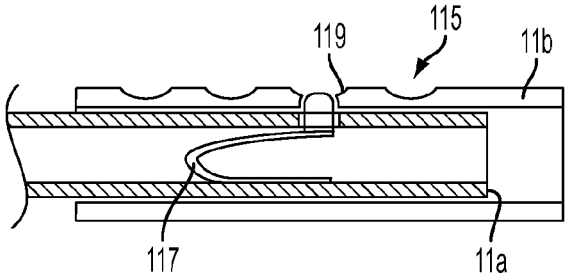
FIGS. 10A-10F illustrate views of an adjustable connector for connecting the top and bottom ground supports.
Figure 10B:
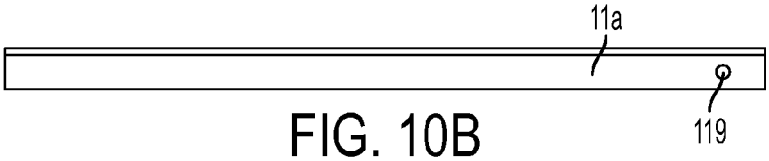
Figure 10C:
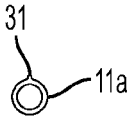
Figure 10D:
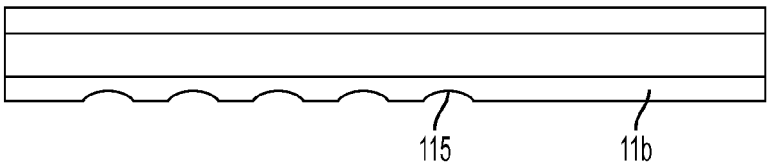
Figure 10E:
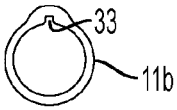
Figure 10F:
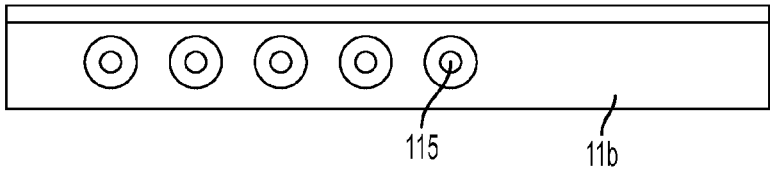
Figure 11A:
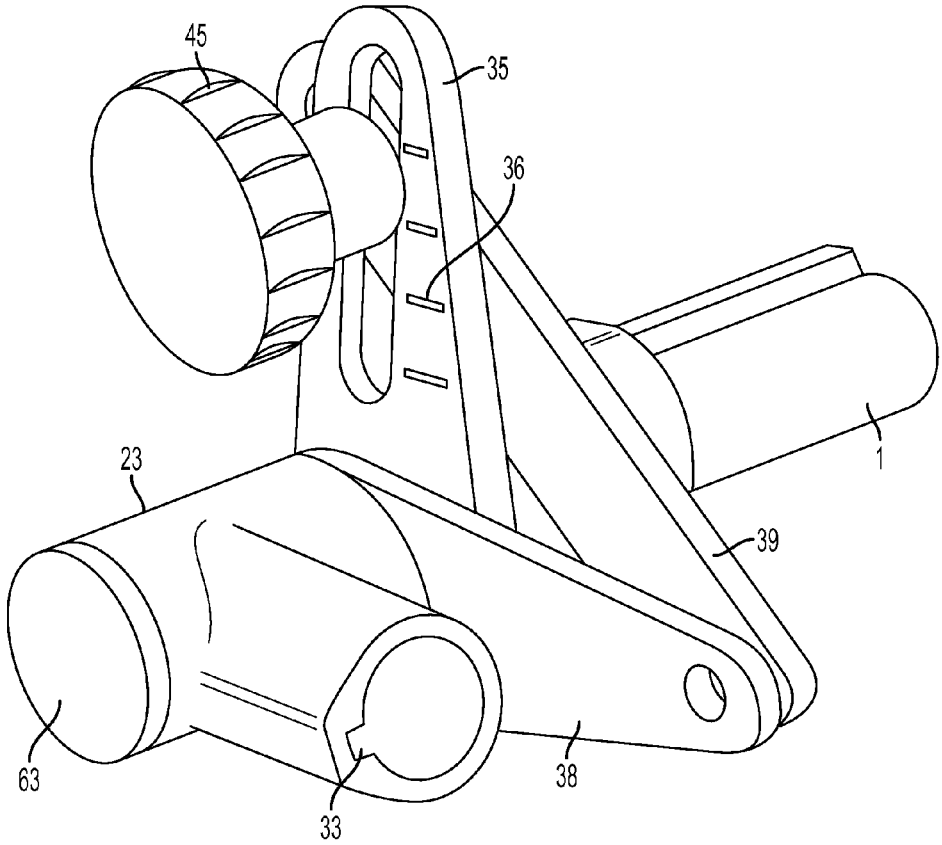
FIGS. 11A-11J illustrate views of an angle adjustment structure.
Figure 11B:
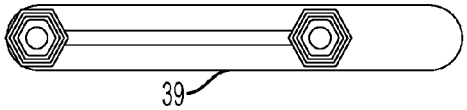
Figure 11C:
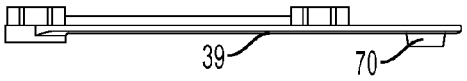
Figure 11D:
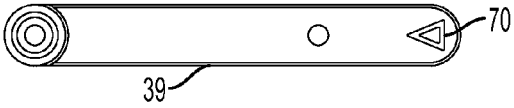
Figure 11E:
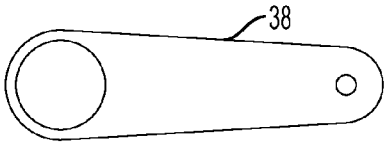
Figure 11F:
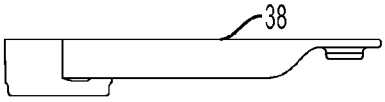
Figure 11G:
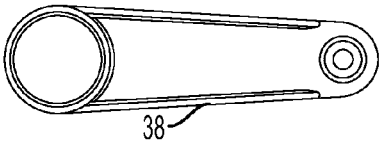
Figure 11H:
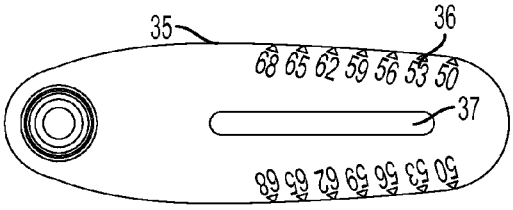
Figure 11I:
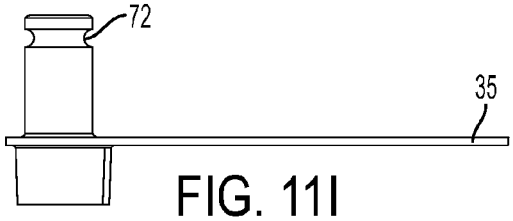
Figure 11J:
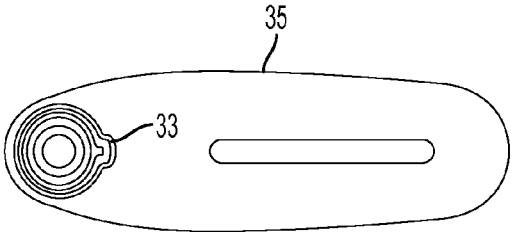

The ground supports 1 and 3 have alignment structure 31 disposed at least at each end thereof and the T-connectors 21 associated with the ground supports 1 and 3 have alignment structure 33, so that when the T-connectors 21 are mounted on the ground supports 1 and 3, the alignment structures 31 and 33 align the T-connectors 21 so that all of the top supports 4 are parallel with one another when mounted in the T-connectors 21 and all of the bottom supports 6 are parallel with one another when mounted in the T-connectors 21. A non-limiting example of alignment structure 31 is a ridge as shown in FIG. 7. A non-limiting example of alignment structure 33 is a recess as shown in FIGS. 8A-8C. The recess is constructed and arranged to accept the ridge. The alignment structures 31 and 33 can be sized and shaped as desired, with the only limitation being that the alignment structures 31 and 33 align the structure having alignment structure 31 with the structure having alignment structure 33.

Preferably, the top supports 4 and bottom supports 6 each have associated alignment structure 31, such as a ridge, and the associated T-connectors 21 have alignment structure 33, such as a recess.

Each ground support 1 and 3 has an associated angle adjustment structure, as shown in FIGS. 11A-11J. The angle adjustment structure includes a rotator 35. The rotator 35 has a degree scale 36 that shows the angle of the top and bottom supports 4 and 6 in relation to the ground and the angle of the plane 30. The rotator 35 includes an alignment structure 33 to align the angle structure 35 with the top or bottom supports 4 and 6. The rotator 35 is rotatably mounted to the corner mount 23. The rotator 35 also includes a slot 37 to adjust the angle of the top and bottom supports 4 and 6. While a slot 37 is shown, other structures can be used as desired, such as holes or friction mounts. The angle structure further includes a flip arm 38 and a connecting rod 39. A first end of the flip arm 38 connects to the ground support 1 or 3 near the rotator 35, such as between the rotator 35 and the corner mount 23. A second end of the flip arm 38 rotatably connects to a first end of a connecting rod 39 using a bolt 41 and nut 42. A second end of the connecting rod 39 rotatably connects to the rotator 35 using a bolt 43 located in the slot 37, a nut 44 and knob 45. The bolt 43 can be slid up or down in the slot 37 to adjust the angle of the rotator 35. The angle of the rotator 35 can be fixed by tightening the nut 44 on the bolt 43 using the knob 45. The connecting rod 39 includes an indicator 70 that indicates the angle on the degree scale 36.

A first side of the rotator 35 rotatably mounts in the corner connector 23. As shown in FIGS. 9A-9E, 11A and 11I, a screw 80 in the corner connector 23 fits within the channel 72, which allows the rotator 35 to rotate within the corner connector 23 but prevents the rotator 35 from being withdrawn from the corner connector 23 while the screw 80 is present in the channel 72. A second side of the rotator 35 accepts the ground support 1 or 3. The second side includes an alignment structure 33 which mates with the alignment structure 31 on the ground support 1 or 3, so that the ground support 1 or 3 rotates as the rotator 35 is rotated.

Figure 12:
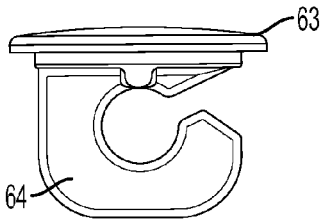
FIG. 12 illustrates a view of an end cap.
Figure 13A:
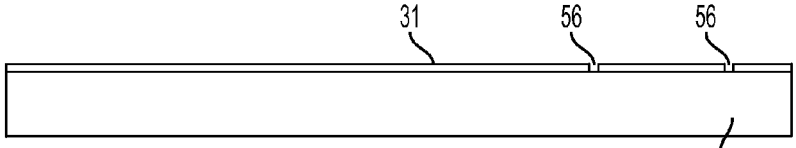
FIGS. 13A-13F illustrate views of a guide.
Figure 13B:
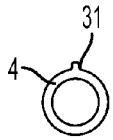
Figure 13C:
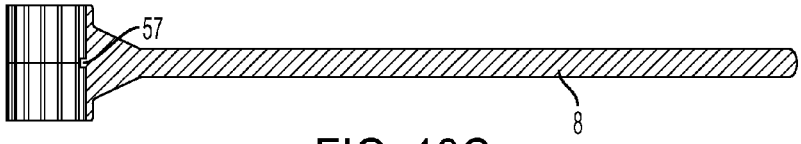
Figure 13D:
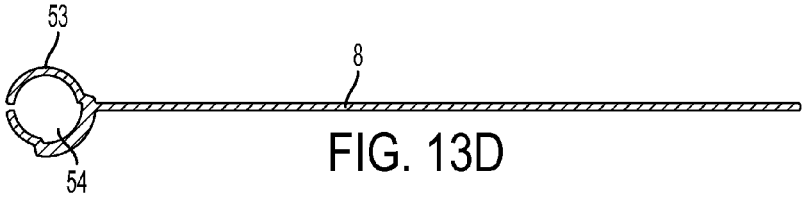
Figure 13E:
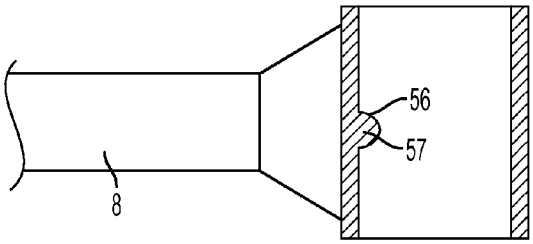
Figure 13F:
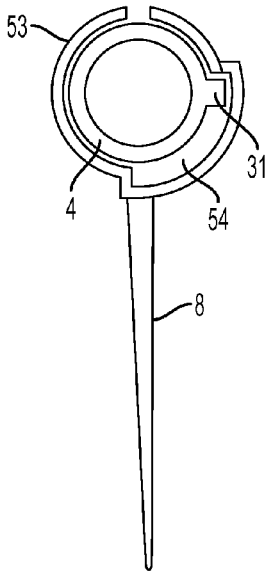

As shown in FIG. 6, bunge cord 60 is used to bias the sections of the ground supports 1 to the T-connectors 21 and associated rotator 35. Bunge cord 61 is used to bias the sections of the grounds supports 3 to the associated T-connectors 21 and rotator 35. Any desired spring or bunge cord can used as desired. The bunge cords 60 and 61 can be mounted using end caps 63. As shown in FIG. 12, the end caps 63 have a hook 64 to which loops at the ends of the bunge cords 60 and 61 can be removably fastened.

As shown in FIGS. 10A-10F, the width 12 can be adjusted by adjusting a length of adjustable connector, shown by connector sections 11*a* and 11*b*. The connector section 11*a* is sized to fit within the connector section 11*b*. The connector section 11*b* has holes 15. A tab 117 is disposed within the connector section 11*a* and protrudes from the hole 119 in the connector section 11*a*. The tab 117 is biased so that it protrudes from the hole 119 unless pushed into the hole 119 by a user. When the connector section 11*a* is disposed within the connector section 11*b*, the total length of the connector can be adjusted by pushing the tab 117 in, moving the connector section 11*a* in relation to the connector section 11*b*, and then setting the total length be allowing the tab 117 to protrude through the hole 119 and one of the holes 115.

The connector section 11*a* has an alignment structure 31, such as a ridge, and the connector section 11*b* has alignment structure 33, such as a recess. In this manner, the alignment structure 31 on the connector section 11*a* and the alignment structure 33 on the connector section 11*b* ensure that when the connector section 11*a* is inserted into the connector section 11*b*, that the connector sections 11*a* and 11*b* are properly aligned for use.

The connector sections 11*a* and 11*b* are connected to the ground supports 1 and 3 using associated corner mounts 23, shown in FIGS. 9A-9E. The corner mount 23 has a opening for accepting the section 11*a*. A short piece of section 11*a* is used to connect a corner mount 23 to the section 11*b*.

As shown in FIGS. 13A-13F, the guides 8 and 10 are formed from a flexible material and constructed so that the guides 8 and 10 are easily deflectable when struck by a shaft 20. The guides 8 and 10 in this embodiment do not return to a static position after being struck by the shaft 20. When deflected by the shaft 20, the guides 8 and 10 remain in the deflected position to provide feedback on which guides 8 and 10 were deflected and by how much. The golfer can bend the deflected guide back to a starting position for reuse. Examples of preferred materials are composites and plastics, such as PVC or nylon.

The guides 8 and 10 have a mount 53 that is constructed to slide onto the top support 4 and bottom support 6. The mount 53 has a protrusion 57 that fits within a notch 56 on the alignment structure 31 in the shape of a ridge. The ridge can have multiple notches 56 so that the guide 8 can be placed at different heights depending upon which notch 56 the protrusion 57 resides. The guide 8 includes a slot 54 in which the alignment structure 31 can slide as the guide 8 rotates around the top support 4. The protrusion 57 is at least a length around the inner surface of the mount 53 so that the protrusion 57 remains in the notch 56 as the guide 8 rotates around the top support 4. The guide 10 and lower support 6 have the same structure as the guide 8 and top support 4.

The parts of Plane Finder are preferably formed from plastic, but if desired, the parts can be formed from other materials such as composites, metals, alloys, or any other desired material. While round tube structures for the ground supports, connectors, top supports, and bottom supports have been shown, other structures, such as square tubes, or even solid structures, can be used as desired. The size of the tubes can be as desired, such as from 1 to 4 inches (2 to 10 cm) in diameter.

Figure 14A:
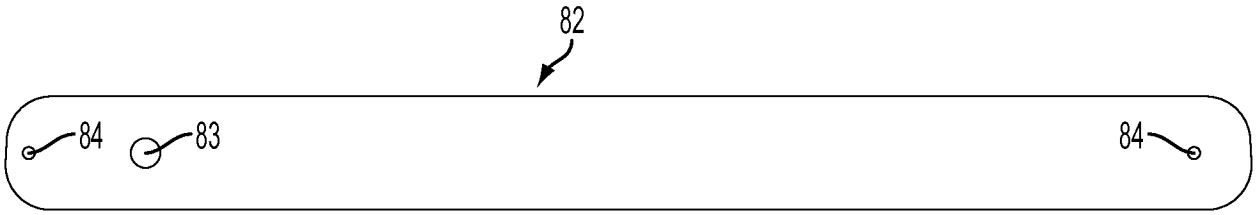
FIGS. 14A and 14B illustrate views of a hitting strip.
Figure 14B:
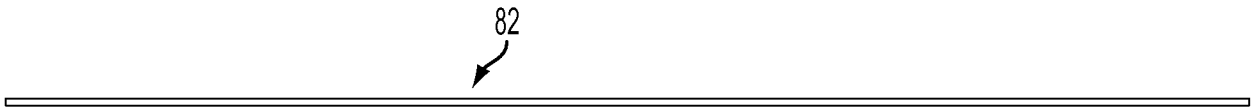

Also provided is a hitting strip for when hitting on grass, as shown in FIGS. 14A and 14B. After the first hit, a divot will occur which will require moving the entire setup after each golf shot. Thus, an optional hitting strip 82 is provided, having hole 83 to hold the golf ball in place, and holes 84 for placing tees to hold the hitting strip 82 in place.

The Plane Finder can be easily transported, set up on site, and adjusted to any desired plane. The golfer simply executes the full swing and if the shaft 20 is off the desired plane 30, the flexible guides 8 and 10 will provide instant feedback so that the golfer can accordingly adjust the downswing path.

While the claimed invention has been described in detail and with reference to specific embodiments thereof, it will be apparent to one of ordinary skill in the art that various changes and modifications can be made to the claimed invention without departing from the spirit and scope thereof.

We claim:

1. A golf plane training device comprising:

a base constructed and arranged to provide a first ground support which during use is on a first side of a resting golf ball facing a golfer addressing the golf ball, a second ground support which during use is on a second side of the resting golf ball facing away from the golfer addressing the golf ball, and a connector connecting the first and second ground supports;

at least two bottom supports connected to the first ground support;

at least two top supports connected to the second ground support;

at least one bottom guide protruding from each bottom support; and at least one top guide protruding from each top support, wherein the top and bottom guides being deflectable so that when a golf shaft contacts the guides during a golf swing the guides deflect without causing damage to the golf shaft, the bottom and top guides defining a space there between through which the golf shaft travels during a downswing and follow through of a golf swing, the space providing a visual representation of a plane the club shaft travels on the downswing and follow through of a golf swing, at least one of the guides or supports being movable to provide different plane angles, the distance between the bottom and top guides being adjustable to change a width of the space there between, and the guides protruding from the supports being constructed and arranged to provide clearance for a club head under the guides and to provide a minimum space width narrower than a width of the club head.

2. A golf plane training device according to claim 1, wherein the guides being constructed and arranged to return to a static position after being deflected by the golf shaft during use.

3. A golf plane training device according to claim 1, wherein at least one of the guides being constructed and arranged to remain in a bent position after being deflected by the golf shaft and being bendable back to a static position during use.

4. A golf plane training device according to claim 1, wherein the bottom supports are non-movably connected to one another and movably connected to the second ground support so that the bottom supports rotate as a unit to adjust the plane angle.

5. A golf plane training device according to claim 1, wherein the top supports are non-movably connected to one another and movably connected to the first ground support so that the top supports rotate as a unit to adjust the plane angle.

6. A golf plane training device according to claim 1, wherein the space width is less than 1 inch.

7. A golf plane training device according to claim 1, wherein the space width is greater than a golf shaft width to less than 6 inches.

8. A golf plane training device according to claim 1, wherein the top and bottom guides and top and bottom supports are constructed and arranged to provide feedback from thigh height during the down swing to thigh height during the follow through of a golf swing.

9. A golf plane training device according to claim 1, wherein the top and bottom guides and top and bottom supports are constructed and arranged to provide feedback from 2 to 3 feet high during the down swing to from 2 to 3 feet high during the follow through of a golf swing.

10. A golf plane training device according to claim 1, further comprising at least three bottom supports.

11. A golf plane training device according to claim 1, wherein the space provides visual representation of the plane in both a horizontal and vertical direction.

12. A golf plane training device according to claim 1, wherein the connector connecting the first and second ground supports is length adjustable such that adjusting the length of the connector adjusts the width of the space.

13. A golf plane training device according to claim 1, wherein the top and bottom guides are from 6 to 24 inches in length measured from the support to a free end of the guide.

14. A golf plane training device according to claim 1, wherein the top and bottom guides are from 10 to 20 inches in length measured from the support to a free end of the guide.

15. A golf plane training device according to claim 1, wherein the top and bottom guides are from 12 to 15 inches in length measured from the support to a free end of the guide.

16. A golf plane training device according to claim 1, further comprising at least two top guides on each top support and at least two bottom guides on each bottom support, wherein the top and bottom guides are arranged over an area of from 5 to 24 inches on the bottom and top supports.

17. A golf plane training device according to claim 1, further comprising at least two top guides on each top support and at least two bottom guides on each bottom support, wherein the top and bottom guides are arranged over an area of from 6 to 15 inches on the bottom and top supports.

18. A golf plane training device according to claim 1, further comprising at least two top guides on each top support and at least two bottom guides on each bottom support, wherein the top and bottom guides are arranged over an area of from 8 to 12 inches on the bottom and top supports.

19. A golf plane training device according to claim 1, further comprising at least two top guides on each top support and at least two bottom guides on each bottom support, wherein the top guides are spaced apart 1 to 6 inches from one another on each top support and the bottom guides are spaced apart 1 to 6 inches from one another on each bottom support.

20. A golf plane training device according to claim 1, further comprising at least two top guides on each top support and at least two bottom guides on each bottom support, wherein the top guides are spaced apart 1 to 2 inches from one another on each top support and the bottom guides are spaced apart 1 to 2 inches from one another on each bottom support.

21. A golf plane training device according to claim 1, wherein the top guides are spaced at least 12 inches from a bottom of the top support and the bottom guides are spaced at least 6 inches from a bottom of the bottom support to provide the clearance for the golf head.

22. A golf plane training device according to claim 1, wherein the top guides are spaced at 18 to 3 inches from a bottom of the top support and the bottom guides are spaced 8 to 18 inches from a bottom of the bottom support to provide the clearance for the golf head.

23. A golf plane training device according to claim 1, wherein the top and bottom supports, the first and second ground supports, and the connector are formed from PVC pipe.

24. A golf plane training device according to claim 1, wherein the top and bottom supports, the first and second ground supports, and the connector comprise a metal.

25. A golf plane training device according to claim 1, wherein the top supports are from 10 to 30 inches in length and the bottom supports are from 6 to 24 inches.

26. A golf plane training device according to claim 1, wherein the top supports are from 12 to 24 inches in length and the bottom supports are from 10 to 18 inches.

27. A golf plane training device according to claim 1, further comprising a hitting strip.

28. A golf plane training device according to claim 1, further comprising T-connectors having alignment structure, wherein the top and bottom supports having alignment structure, the top and bottom supports being connected to the T-connectors such that the alignment structure of the top supports aligning the top supports parallel with one another when mounted in the T-connectors and the alignment structure of the bottom supports aligning the bottom supports parallel with one another when mounted in the T-connectors, the first and second ground supports comprising sections, each section having alignment structure and being mounted in the T-connectors, so that when the first ground support is rotated all of the bottom supports rotate in unison with the first ground support and when the second ground support is rotated all of the top supports rotate in unison with second ground support.

29. A golf plane training device according to claim 28, wherein the guide comprises a mount that is constructed to slide onto the top support or bottom support, the mount having a protrusion and the top and bottom supports having notches in the alignment structure, the protrusion constructed to fit within at least one of the notches to adjust the height of the guide, the mount comprising a slot in which the alignment structure on the top or bottom support can slide as the guide rotates around the top or bottom support, the protrusion is at least a length around the inner surface of the mount so that the protrusion remains in the notch as the guide rotates around the top or bottom support, the guide rotating around the top or bottom support when struck by a golf club shaft during a golf swing.

30. A golf plane training device according to claim 28, wherein the bottom supports rotate as unit as the first ground support is rotated and the top supports rotate as a unit as the second ground support is rotated, further comprising first alignment structure constructed to rotate the first ground support and lock the first ground support in a desired position, and second alignment structure constructed to rotate the second ground support and lock the second ground support in a desired position.

31. A golf plane training device according to claim 28, further comprising a first bunge biasing the first ground support sections and associated T-connectors together, and a second bunge biasing the second ground support sections and associated T-connectors together.

32. A method of obtaining feedback on a golf plane comprising:

setting up a golf plane training device according to claim 1;

setting a desired plane angle defined by the space between the guides;

setting a width of the space between the guides that is wider than a golf club shaft;

placing a golf ball in the golf plane training device; and swinging a golf club so that a face of the golf club head strikes the golf ball, the shaft travels in the space between the guides, and the head travels below the guides, feedback being provided by the space between the guides and when the shaft strikes a deflectable guide.

33. A method according to claim 32, wherein at least one of the top and bottom guides being constructed and arranged to remain in a bent position after being deflected by the golf shaft and being bendable back to a static position during use, the method further comprising gaining feedback from a guide that has been deflected by an errant golf swing, and bending the deflected guide back to the static position.

* * * * *